US010881170B1

(12) United States Patent
Hunsucker et al.

(10) Patent No.: US 10,881,170 B1
(45) Date of Patent: Jan. 5, 2021

(54) BELT BUCKLE SYSTEM

(71) Applicants: Tom Hunsucker, Alta Loma, CA (US); Edward Rowland, Alta Loma, CA (US)

(72) Inventors: Tom Hunsucker, Alta Loma, CA (US); Edward Rowland, Alta Loma, CA (US)

( * ) Notice: Subject to any disclaimer, the term of this patent is extended or adjusted under 35 U.S.C. 154(b) by 0 days.

(21) Appl. No.: 14/953,325

(22) Filed: Nov. 28, 2015

Related U.S. Application Data

(60) Provisional application No. 62/085,600, filed on Nov. 30, 2014.

(51) Int. Cl.
*A44B 11/00* (2006.01)
*A44B 11/02* (2006.01)
*A41F 9/00* (2006.01)

(52) U.S. Cl.
CPC ..... *A44B 11/005* (2013.01); *A41F 9/002* (2013.01); *A44B 11/02* (2013.01)

(58) Field of Classification Search
CPC ..... A44B 11/005; A44B 11/006; A44B 11/06; A44B 11/10; A44B 11/12; A44B 11/14; A44B 11/18; A44B 11/02; A41F 9/002
USPC ..... 2/317, 318, 319, 320, 321, 322, 323
See application file for complete search history.

(56) References Cited

U.S. PATENT DOCUMENTS 1,558,406 A * 10/1925 Snyder ..... G09F 3/005 24/3.7
1,578,468 A * 3/1926 Rankin ..... A44B 11/005 24/163 R
2,159,857 A * 5/1939 Mix ..... A41F 9/002 2/301
2,709,393 A * 5/1955 Anderson ..... G08B 5/004 2/300
3,466,668 A * 9/1969 Ochiai ..... A44B 11/12 2/322
3,927,442 A * 12/1975 Foster ..... A44B 11/005 24/163 K
4,113,157 A * 9/1978 Woodbury ..... A44B 11/005 206/37
4,753,377 A * 6/1988 Poluhowich ..... A44B 11/005 2/338
4,844,373 A * 7/1989 Fike, Sr. ..... A47F 13/04 242/588.1
4,905,857 A * 3/1990 Her ..... A45C 11/22 190/28
5,299,324 A * 4/1994 Zinna ..... A41F 9/002 2/311
5,381,318 A * 1/1995 Fang ..... G01B 3/1084 33/760
6,083,183 A * 7/2000 Yang ..... A61F 5/028 128/876
6,185,797 B1 * 2/2001 Lan ..... A44B 11/12 24/647
6,665,915 B1 * 12/2003 Higuchi ..... A44B 11/006 24/615

(Continued)

*Primary Examiner* — Tajash D Patel

(57) ABSTRACT

Belt adjustment systems are configured for wearing around a user's waist and permit a continuum of belt loop sizes or a larger selection of belt loop sizes. The belt adjustment system includes an elongate belt member having a first end, a second end and a series of teeth positioned on an inner surface near the second end and a fixation member having first and second adjustment elements.

6 Claims, 8 Drawing Sheets

(56) References Cited

U.S. PATENT DOCUMENTS

| | | | | |
|---|---|---|---|---|
| 7,757,359 | B2 * | 7/2010 | Iten | A44C 5/246 2/322 |
| 8,302,266 | B2 * | 11/2012 | Chen | A44B 11/001 16/302 |
| 8,714,358 | B2 * | 5/2014 | Debitzky | B65H 75/4473 206/702 |
| 9,089,124 | B1 * | 7/2015 | Cox | A01M 31/00 |
| 9,215,911 | B1 * | 12/2015 | Carnley | A44B 11/005 |
| 2004/0099702 | A1 * | 5/2004 | Conner | A44B 11/005 224/163 |
| 2006/0053531 | A1 * | 3/2006 | McBride | A41F 9/025 2/317 |
| 2007/0179466 | A1 * | 8/2007 | Tremblay | A61F 13/55145 604/385.02 |
| 2007/0294807 | A1 * | 12/2007 | Van Cotthem | A41F 9/002 2/321 |
| 2008/0155793 | A1 * | 7/2008 | Chen | A44B 11/02 24/191 |
| 2010/0251462 | A1 * | 10/2010 | Bauhuis | A44B 11/06 2/322 |
| 2013/0097824 | A1 * | 4/2013 | Chadwick | A61F 5/3776 24/587.12 |
| 2013/0239375 | A1 * | 9/2013 | Horimoto | A42B 3/08 24/69 ST |
| 2015/0113770 | A1 * | 4/2015 | Laatz | A44B 11/125 24/191 |
| 2015/0366299 | A1 * | 12/2015 | Huang | A44B 11/12 24/163 R |
| 2016/0174664 | A1 * | 6/2016 | West | A45F 5/021 2/300 |

* cited by examiner

BELT BUCKLE SYSTEM

REFERENCE TO PRIORITY DOCUMENT

This patent application claims priority to U.S. Provisional Patent Application Ser. No. 62/085,600 entitled "Belt Buckle System" and filed on Nov. 30, 2014. Priority to the aforementioned filing date is hereby claimed and the provisional patent application is incorporated herein by reference in its entirety.

BACKGROUND

Conventional belt buckles or belt adjustment systems are limited in their ability to conform to a particular user's waist size. Belt adjustment systems conventionally secure a belt about a user's waist by relying on a series of spaced holes punched through an end of a belt. A hook of a belt buckle can be inserted through a hole to capture the end of the belt to secure the belt in a loop of a particular size. The spacing between each of the holes as well as the overall number of holes can vary for adjustment of belt size, but is generally limited by the minimal material that must remain between the holes.

Conventional belt adjustment systems are limited to setting the size of the belt loop to discrete sizes based upon the spacing of the holes in the belt. If a user desires to set the belt to a loop size that is positioned between the holes in the belt, the user has to manually create an additional hole in the belt, which can be difficult and unattractive if not performed well. Alternately, the user must use the next smaller or next larger belt loop size relative to the desired size, which can be uncomfortable for the user.

Other belt adjustment systems are known that increase the flexibility of adjustment to a variety of waist sizes, but these adjustment systems are not typically fashionable or aesthetically pleasing.

SUMMARY

There is a need for a belt adjustment system that permits a continuum of belt loop sizes or a larger selection of belt loop sizes. Disclosed herein are clothing accessories, particularly belt adjustment systems for wearing around a user's body such as around the waist. The belt adjustment system includes a belt and a buckle wherein the belt can be looped and secured to the buckle to secure the belt around a user's waist or other portion of the body. U.S. patent application Ser. No. 13/338,562, filed Dec. 28, 2011, is related and is incorporated herein by reference in its entirety.

In an embodiment, the buckle includes a front face that is movable between an open and closed position to reveal or hide, respectively, a chamber within the buckle. The chamber is sized and shaped to contain one or more items when the front face is closed. In an embodiment, the items include at least one golf ball marker and at least one golf divot repair tool that also serves as a bottle opener. The buckle has a body with a thin side profile that is not overly bulky such that it can comfortably fit over the button region of a wearer's pants.

In one aspect, there is disclosed a belt system, comprising: an elongate belt member comprising a first end, a second end and an inner surface near the second end; a buckle on a first end of the belt member, the buckle adapted to engage the second end of the belt member in a pinless manner such that the belt does not require holes and the buckle does not require a pin; wherein the buckle has a body with a cut out region that is positioned over a user's pant button when the belt is worn such that the button does not contact the belt buckle when worn.

Other features and advantages should be apparent from the following description of various embodiments, which illustrate, by way of example, the principles of the claimed subject matter.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing particular embodiments only, and is not intended to be limiting. Unless defined otherwise, all technical terms used herein have the same meaning as commonly understood by one skilled in the art to which this subject matter belongs.

Figure 1:
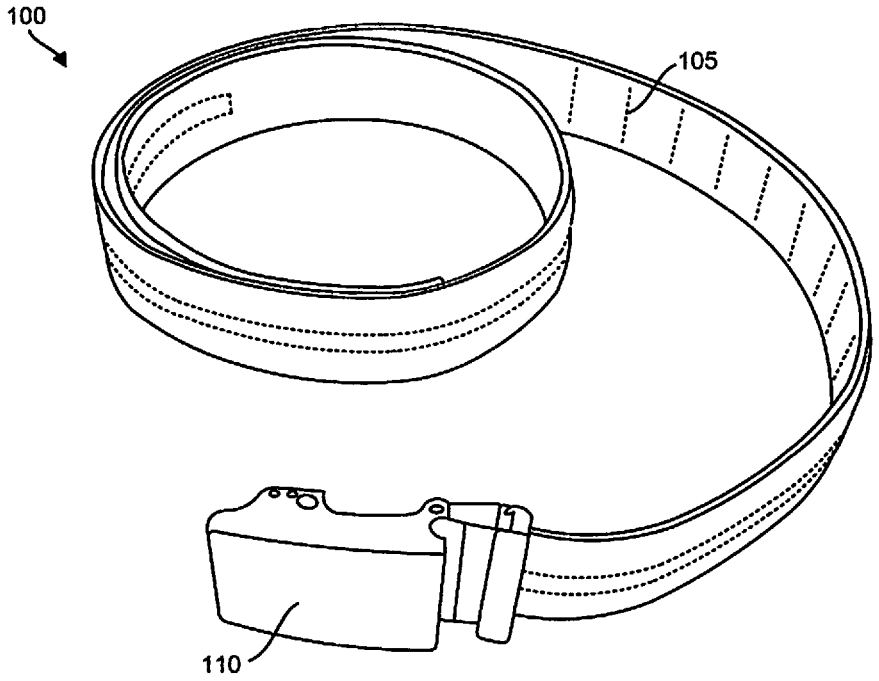
FIG. 1 shows a schematic view of an embodiment of a belt system.

FIG. 1 shows a perspective view of an embodiment of a belt system 100 that may be worn with a pair of pants, shorts, trousers, skirts or other articles of clothing. The system 100 can also be used with other items such as watch straps, purse straps, guitar straps or animal collars or other articles that may include a buckle system that is adjusted for size or where a number of size variations would be desirable. Some figures include exemplary numerical dimensions. It should be appreciated that the dimensions are for example only and are not intended to be limiting. The belt buckle system can be configured with dimensions outside of the ranges and values shown.

The belt system 100 includes an elongated belt 105 and a buckle 110 disposed on a first end of the belt 105. The buckle 110 is removably attached to the belt such as by using a clamp on the buckle 110. The belt buckle 110 is a pinless buckle in that it does not use a pin to secure itself to the belt 105 when the belt is looped around a user's waist. The belt buckle 105 has a front face that faces away from a user or a user's torso when the belt is worn around the user's waist. That is, the belt buckle 105 sits flat against the user's waist or torso such that the buckle will be positioned over the region of the user's pants where a button is typically located on the user's pants.

Figure 2:
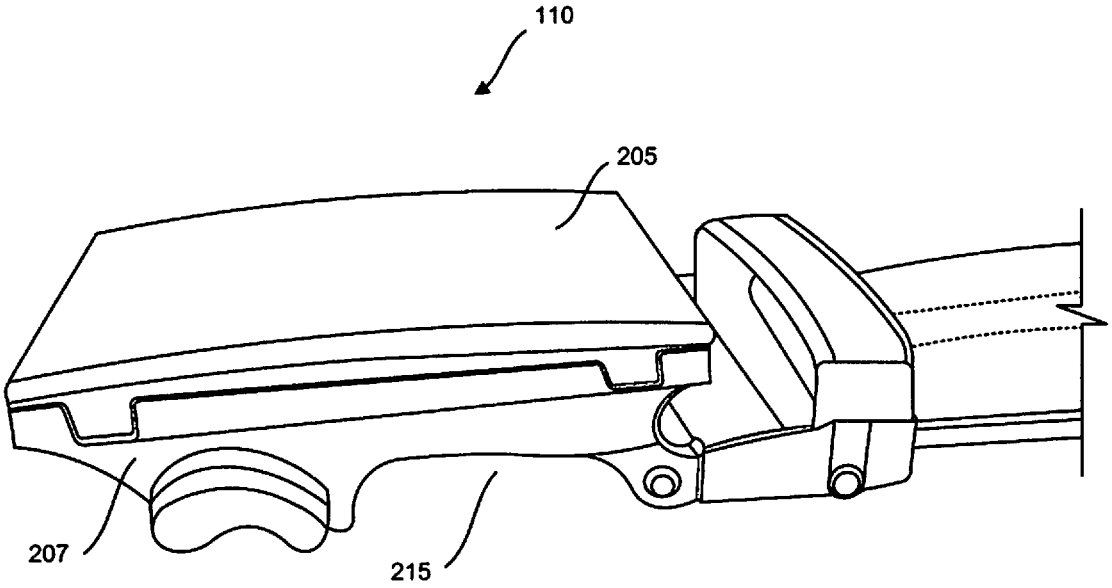
FIG. 2 shows a perspective, side view of a belt buckle of the belt system.
Figure 3:
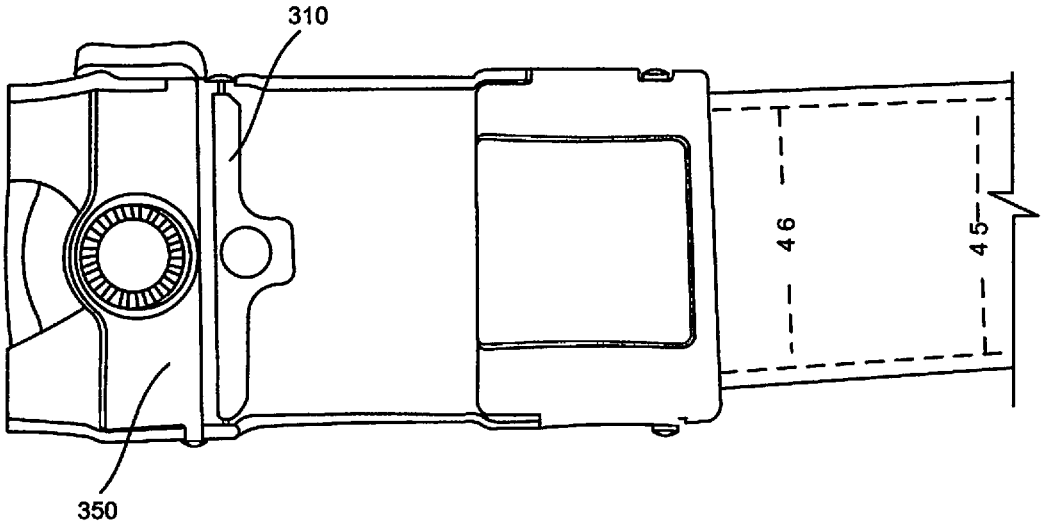
FIG. 3 shows a bottom view of the belt buckle.
Figure 4:
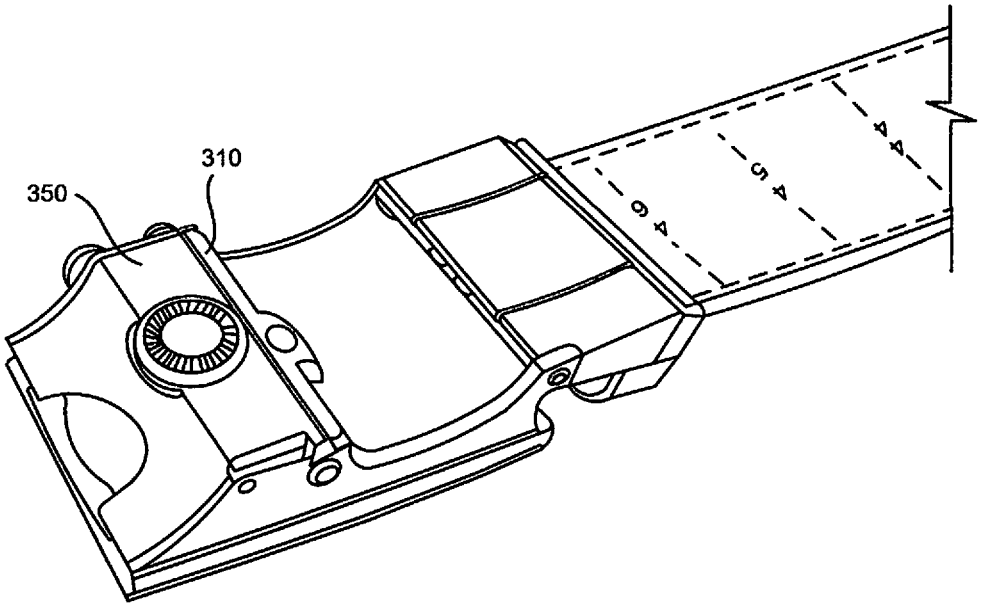
FIG. 4 shows a bottom view of the belt buckle.

FIG. 2 shows a perspective, side view of the belt buckle 110. FIGS. 3 and 4 show bottom views of the belt buckle 110. The belt buckle 110 has a front face that is formed by a door 205 or other movable portion. The door 205 is movable relative to a body 207 of the belt buckle such that the door 205 can be opened (such as in a pivoting manner) relative to the body to expose an internal chamber, as described in more detail below.

With reference to FIGS. 3 and 4, the buckle 110 has a bridge 305 that forms or at least partially defines an opening through which the opposite end of the belt can be threaded when worn by a user. A movable latch 310 or other pinless member is configures to move towards and engage with a portion of the opposite end region of the belt when the opposite region is positioned through the opening formed by the bridge 305 for securing the belt to the buckle in a desired position. In an embodiment, the latch 310 secures to a tooth or other engagement portion formed within a row of engagement portions on the belt. The latch 310 can be biased toward a latching engagement with the belt such as by using a biasing member, which can be, for example, a magnet, a spring, or other device.

With reference to the side view of FIG. 2, the body 207 of the buckle 110 is shaped such that a cavity or cut out 215 is formed on the side of the body 207. The cut out 215 is such that a region of the body 207 is thinner relative to an adjacent region, with the region being thinner along a dimension or direction normal to a wearer's body when the belt is worn around the wearer's waist. That is, the direction is a direction along the line of sight of a person that is facing the wearer and looking toward the front side of the wearer. In this manner, the body of the buckle is so dimensioned so that the wearer's pants button does not contribute to or cause the belt buckle to protrude any further outward from the wearer's pants if the wearer's pants did not have a button in the region of the buckle when the buckle is worn. The cut out is so dimensioned relative to a wearer's pant button so that the pant button fits within the cut out.

The cut out 215 is sized and shaped to form a gap in the body of the buckle in which the wearer's pants button can be positioned when the belt is worn. In this manner, the buckle can be positioned atop the button without the button contributing to the overall size of the buckle or pushing the buckle outward away from the user's body. The button therefore does not interfere with the belt buckle and does not result in the buckle being pushed outward from the user's body when the belt is worn around the waist. FIG. 2 shows one side view of the belt buckle. It should be appreciated that the opposite side view of the belt buckle also has a cutout 215 similar to the cutout 215 shown in FIG. 2. The cut out 215 is located along the length of the belt buckle with the length being the longitudinal direction of the belt member. The cutout 215 extends along only a portion of the entire length of the belt buckle such that the belt buckle has a thickness that is greater where the cavity or cutout 215 is not located relative to whether cavity or cutout 215 is located.

Figure 5:
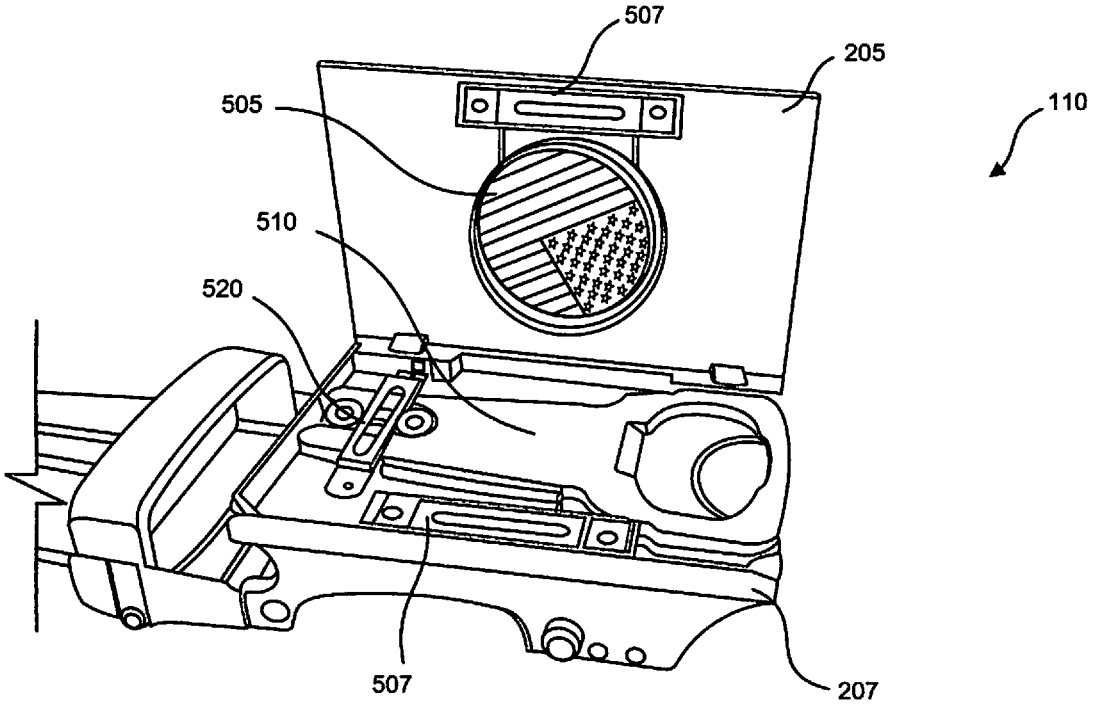
FIG. 5 shows the belt buckle with a door in an open state such that an internal chamber is exposed.

FIG. 5 shows the belt buckle 110 with the door 205 in an open state such that the internal chamber is exposed. The internal chamber is exposed and accessible when the door 205 is open as shown in FIG. 5. When the door 205 is closed (as in FIGS. 1 and 2 for example), the door 205 is positioned relative to the belt buckle body such that the internal chamber is covered and hidden by the door 205. In this manner, the internal chamber is collectively formed by the body of the belt buckle and the door 205 when the door is closed.

The door 205 may move relative to the body of the belt buckle in a variety of manners including in a pivoting or rotating manner. In this regard, the one or more hinges attach the door 205 to the belt buckle body. Other types of movement are possible such as a sliding movement between the door 205 and the body.

Figure 6:
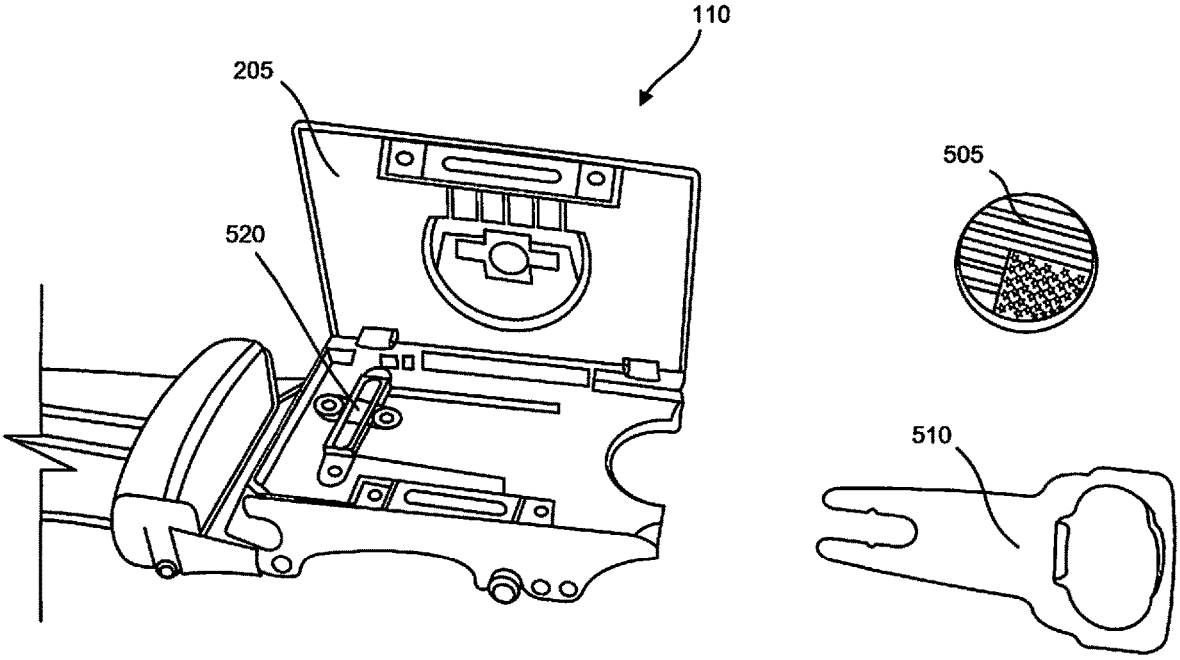
FIG. 6 shows the belt buckle with a door in an open state such that an internal chamber is exposed and components removed from the internal chamber.

As shown in FIG. 5, the internal chamber is sized and shaped to contain one or more items. The items are covered or hidden when the door 205 is closed. In the illustrated embodiment, the items include a ball marker 505, which is disc-like member. The ball marker is positioned within a complementary-shaped indentation on the inner side of the door 205 and can be secured thereto such as by a magnet for example. The items also include a golf divot repair tool 510 that sits on the body 207 in the internal cavity. The divot repair tool 510 is secured within the cavity by a crossing member 520 that fits over the divot repair tool and secures it therein such as in a press fit manner. Other retaining elements can also be used such as one or more magnets to secure the divot repair tool 510 or other items in the chamber. FIG. 6 shows the buckle 110 with the ball marker 505 and divot repair tool 510 removed from the internal chamber.

With reference to FIG. 5, the door 205 can be secure in the closed position such as by using one or more magnetic engagements 507 between the body 207 of the buckle and the door 205. In this regard, a magnet may secure in the door 205 and/or the body 207 so that they contact one another and secure the door in the closed position when the door is closed. The magnet(s) may be positioned and secured beneath a securing element, such as a bridge structure. Other ways of securing the door in the closed position can be used.

Figure 7:
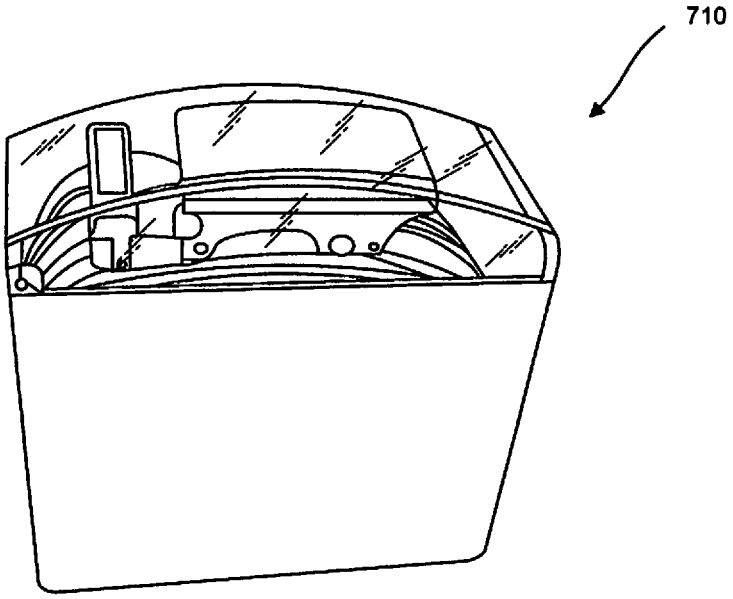
FIG. 7 shows an example of a belt container in which the belt can be stored.
Figure 8:
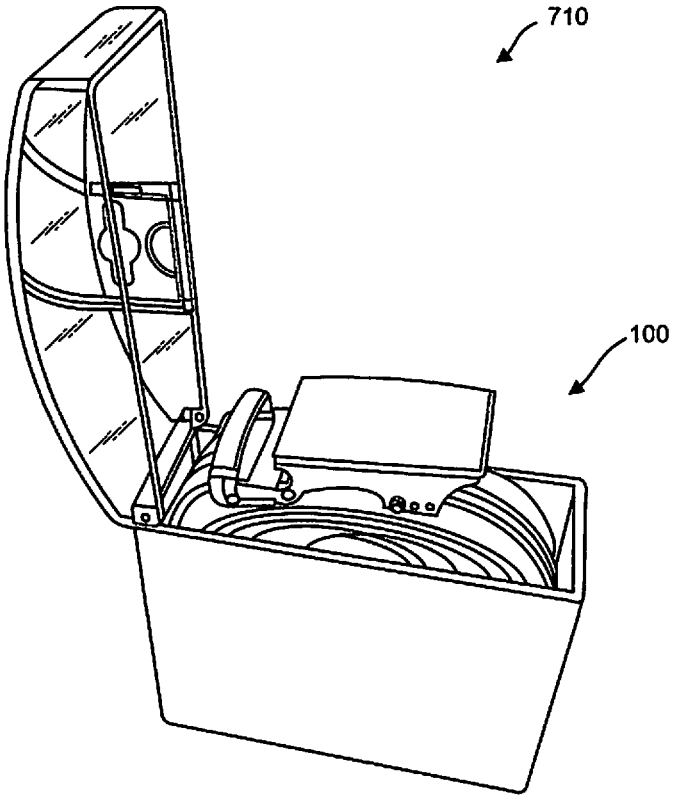
FIG. 8 shows the belt container in an open state.

In an embodiment, the belt 100 can be stored in a belt container 710, as shown in FIGS. 7 and 8. The belt container 710 is sized and shaped to define an interior cavity that can contain the belt 100 in a rolled state. The interior cavity of the container 710 is sized so that the belt 100 is snugly stored within the container 710 such that the belt will not rattle or move when the container is closed. In this regard, the container 710 has a door that can be opened (as shown in FIG. 8) and closed (as shown in FIG. 7) to provide access to the belt.

Although embodiments of various methods and devices are described herein in detail with reference to certain versions, it should be appreciated that other versions, embodiments, methods of use, and combinations thereof are also possible. Therefore the spirit and scope of the appended claims should not be limited to the description of the embodiments contained herein

What is claimed is:

1. A belt system, comprising:

an elongate belt member comprising a first end, a second end and an inner surface near the second end;

a buckle on the first end of the belt member, the buckle adapted to engage the second end of the belt member in a pinless manner such that the belt does not require holes and the buckle does not require a pin, the buckle defining an opening sized to receive the second end of the belt when worn by a user; and a belt container having an internal cavity sized and shaped to store the elongate belt member in a rolled state and to also store the entire buckle, the container having a rectangular prism shape such that the belt and the buckle fits snugly within the container such that the belt will not rattle or move within the container when the container is closed, wherein the container has a container door and a base, and wherein the base defines an external and internal rectangular prism shape and the container door has a curved shape, and wherein the container door rotates and pivots to an open position while remaining attached to the base of the belt container and wherein the container door is rigid so that the container door retains the curved shape when opened, and wherein the base of the belt container forms an opening sized to receive the belt and the belt buckle, wherein both the belt member and the entire buckle are contained within the cavity of the belt container.

2. The belt system as in claim 1, further comprising a buckle door on the belt buckle that opens and closes to reveal a hidden compartment.

3. The belt system as in claim 2, wherein the compartment is sized and shaped to contain at least one of a ball marker and a divot repair tool.

4. The belt system as in claim 2, wherein the buckle door separates from the body of the belt buckle.

5. The belt system as in claim 4, wherein the buckle door is pivotably attached to the body of the belt buckle.

6. The belt system as in claim 1, wherein the container door has an upper external, convex surface and a pair of external, opposed flat surfaces.

* * * * *